United States Patent [19]

Yasuda

[11] Patent Number: 4,753,322

[45] Date of Patent: Jun. 28, 1988

[54] TRIPLE-WRAP TRACTION ARRANGEMENT

[75] Inventor: Kentaro Yasuda, Southington, Conn.

[73] Assignee: Otis Elevator Company, Farmington, Conn.

[21] Appl. No.: 870,041

[22] Filed: Jun. 3, 1986

[51] Int. Cl.[4] ..... B66B 11/04

[52] U.S. Cl. ..... 187/20; 254/390

[58] Field of Search ..... 187/20, 22; 254/390, 254/393, 389

[56] References Cited

U.S. PATENT DOCUMENTS

| | | | |
|---|---|---|---|
| Re. 4,269 | 2/1871 | Otis . | |
| 31,128 | 1/1861 | Otis . | |
| 418,051 | 12/1889 | Newton | 187/20 |
| 482,054 | 9/1892 | Zoschnick | 187/20 |
| 1,279,253 | 9/1918 | Carey | 187/20 |
| 3,332,665 | 7/1967 | Bruns | 187/20 |

*Primary Examiner*—Joseph J. Rolla
*Assistant Examiner*—Kenneth Noland
*Attorney, Agent, or Firm*—Lloyd D. Doigan

[57] ABSTRACT

A traction elevator rope (4) is helically wrapped about at least 360° of the periphery of a drive sheave (2) to provide sufficient traction for low-speed elevator operations without excessive wear or seizing and to provide sufficient traction in high-speed elevator operations without excessive wear or high drive sheave loading.

2 Claims, 1 Drawing Sheet

TRIPLE-WRAP TRACTION ARRANGEMENT

TECHNICAL FIELD

This invention relates to a rope and drive sheave arrangement for a traction elevator.

BACKGROUND ART

Generally, an elevator car is supported by a wire rope that is attached, at an end, to an elevator car, passed over a drive sheave, and attached, at the other end, to a counterweight. The elevator car is raised or lowered through traction developed between the wire rope and the drive sheave, which is rotated by an electric motor. Usually, the drive sheave is arranged above the elevator car and counterweight; using pulleys to direct the rope, however, the sheave may be located below the counterweight and elevator car.

Typically, the wire rope is arranged on the drive sheave in one of two basic ways. One way, generally used in low speed applications (i.e., low-rise buildings), uses a single-wrap traction arrangement by which the rope contacts about 180° of a groove within the periphery of the drive sheave. To improve the traction between the rope and the groove, the groove is often shaped, e.g. with a V-cut or undercut, or provided with a plastic insert. (Such an insert is disclosed in commonly owned U.S. Pat. No. 3,279,762.) Shaped grooves and groove inserts, however, increase wear and may cause the rope to be seized within the groove. This "seizing" may cause the rope to snarl or bend excessively, and may also prevent the rope from slipping as desired when the counterweight tension is removed from the rope (i.e., when the counterweight bottoms in a shaft).

A second way of arranging the rope on the sheave, used generally in high-speed applications (i.e., high-rise buildings), uses a double-wrap traction arrangement by which the rope contacts approximately 180° of each of two parallel grooves provided within the periphery of the drive sheave for increased traction. A secondary sheave under the drive sheave serves as an idler to axially displace the rope, after one wrap (180°) in one groove within the drive sheave, for a second wrap (180°) in the other groove in the drive sheave. (A double-wrap traction arrangement is disclosed in U.S. Pat. No. 4,030,569.) Because rope lengths used in high-rise applications are substantial, replacing the ropes is very expensive, and rope wear therefore should be minimized. The drive sheave in a double-wrap arrangement frequently utilizes U-shaped grooves and thereby avoids the excess wear and the seizing caused by plastic inserts or shaped grooves. However, the load on the drive sheave used with a double-wrap arrangement is the sum of the loads on the rope leading to the car and counterweight plus the loads leading to and from the secondary sheave. In effect, the lead is two times the sum of the loads on the rope leading to the car and counterweight. This "double loading" can lead to excessive wear on the sheave drive shaft and the bearings that support the sheave drive shaft. Moreover, the rope may wear more rapidly than in the single-wrap arrangement because it is required to bend three times (in contrast to the single-wrap arrangement wherein the rope bends one time). The rope bends when it first engages the drive sheave, straightens when it leaves the drive sheave, bends again around the idler sheave, straightens as it leaves the idler sheave and bends again as it passes about the driven sheave for the final time. The effect on the rope is roughly equivalent to continually bending a paper clip.

DISCLOSURE OF INVENTION

It is an object of the invention to provide a traction arrangement between a drive sheave and an elevator rope for application in both high and low speed environments that extends rope life, while increasing traction without seizing and while minimizing sheave shaft loading.

According to the invention, an elevator rope is helically wrapped for at least 360° within a groove disposed in the periphery of a drive sheave. The groove has a width of at least twice the diameter of the rope, and a depth of a less than half the diameter of the rope to minimize friction between the rope and the edges of the groove. The groove has a flat bottom to facilitate the rope's movement from one side of the groove to the other as the sheave drives the rope.

According to one aspect of the invention, the sheave groove continuously receives an approximately 540° helical wrap of the rope.

BEST MODE FOR CARRYING OUT THE INVENTION

Figure 1:
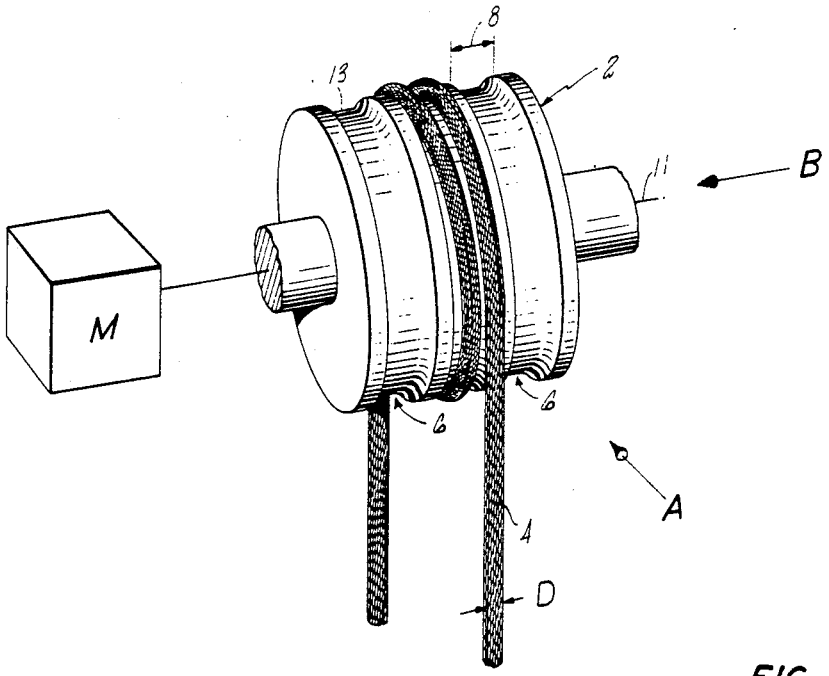
FIG. 1 is a perspective view of a sheave with a rope wrapped thereon in accordance with the invention.
Figure 2:
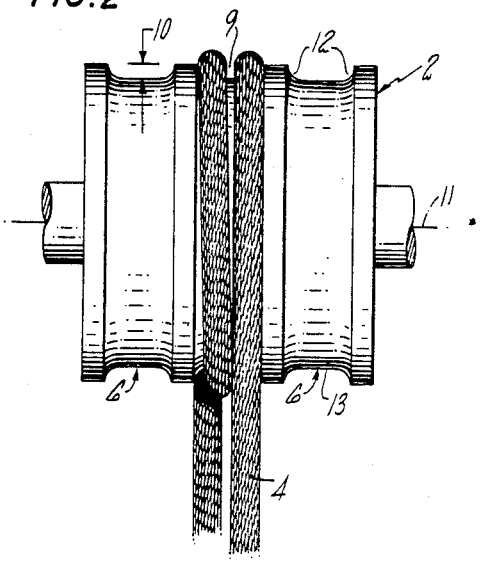
FIG. 2 is a view of the drive sheave of FIG. 1 as seen from the direction A.
Figure 3:
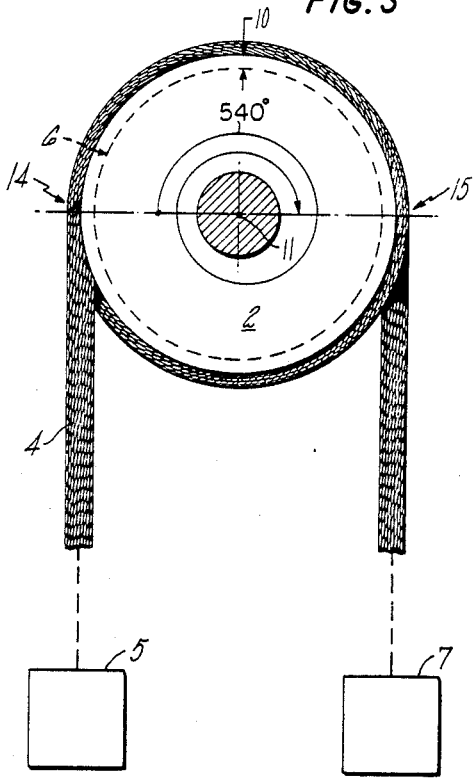
FIG. 3 is a view of the drive sheave of FIG. 1 as shown from the direction B.

Referring to FIGS. 1, 2 and 3, a drive sheave 2, having a plurality of grooves 6 for receiving a rope 4 therein, is shown. The number of grooves 6 corresponds to the number of ropes required to support the cab and the counterweight. The rope 4, constructed of a multiplicity of steel strands and having a diameter D, connects at one end to an elevator cab 5 and at the other end to a counterweight 7. When the sheave is driven about a drive axis 11 by a motor (shown schematically as M), traction between the rope and sheave within the groove induces the cab and the counterweight to move.

Each groove has a width 8 slightly more than twice the rope diameter D to create a gap 9 between the juxtaposed segments of the rope to avoid friction therebetween as the sheave drives the rope. Each groove has a depth 10 that is less than half the diameter D of each rope to prevent the sides of the grooves from abraiding the rope as the rope passes on and off the sheave. Axially spaced apart side portions 12 of each groove have a cross-sectional arc of about 90° conforming generally to the circumferential portion of the rope in contact with the sides of the groove. Each groove has a flat bottom portion 13 connecting each side portion. The bottom is flat because the rope must cross over helically from one side of the groove to the other side of the groove as the sheave rotates. A concave-shaped bottom would cause the adjacent wraps of rope in the groove to migrate towards, and abraid, each other. A convex shaped bottom would inhibit the rope from crossing from one side of the groove to the other causing the rope to wrap upon itself as the sheave is driven.

In a triple-wrap arrangement, the rope is helically wrapped (experiencing one bend) around 540° of the sheave within the groove. During rotation of the sheave, the rope enters one side portion of the groove at a "pay-on" point 14, wraps 180° (one wrap) on the one side of the groove over the upper half of the sheave, continues to wrap another 180° (a second wrap) arouand the lower half of the sheave, continues to wrap 180° (a third wrap) on the other side portion of the groove over the upper half of the sheave, and exits from the groove at a "pay-off" point 15. The rope, at the pay-on point 14, tends to push the third wrap to the other side of the groove as the second wrap moves axially from one side of the groove to the other side. Abrasion between the juxtaposed segments of the rope (i.e., the first and third wraps) is minimized because of the gap 9 therebetween and because there is no relative motion between those segments resting within the groove as the sheave is driven. There may be relative radial motion between the juxtaposed segments at the pay-on and pay-off points but contact is minimized at those points by a tendency of the rope to "track" at either side of the groove as the sheave is driven.

At least 360° of contact between the rope and the sheave provides increased traction between the rope and the sheave, and therefore, no plastic inserts, or undercuts or V-shaped grooves, are required. The problems of excessive rope wear and seizing, associated with single wrap arrangements, in which inserts and shaped grooves are used to improve traction, are avoided. The problems of excessive rope bending and double loading, found in double-wrap arrangements, are also avoided. Yet, there is no reduction in traction. Moreover, the rope can easily disengage from the sheave when the counterweight tension is removed.

It should be understood that the invention is not limited to the particular embodiments shown and described herein, but that various changes and modifications may be made without departing from the spirit and scope of the invention as defined by the following claims:

We claim:

1. An elevator drive system having a rope attached at one end to a cab and at another end to a counterweight, and a drive sheave having a periphery rotatable about a drive axis, said sheave having a groove disposed within said periphery for receiving said rope characterized by:

said groove having two, axially spaced, side portions, each said side portion having a cross-sectional arc of approximately 90°;

said groove having a flat bottom portion connecting said side portion for allowing said rope to cross from one side portion of the groove to another side portion as said sheave rotates about said axis;

said groove having a width of at least twice a diameter of said rope plus a fraction thereof, to create a gap between a pair of juxtaposed helical segments of said rope in an upper periphery of said groove, said gap reducing friction between said helical segments and to respectively position each of said juxtaposed helical segments against a respective one-of-said side portions against said flat bottom portion of said groove, and said groove having a depth of less than one half of said diameter of said rope;

said groove receiving greater than a 360° helical wrap of said rope therein.

2. The drive system of claim 1 further characterized by:

said groove receiving approximately a 540° helical wrap of said rope therein.

* * * * *